United States Patent [19]

Goldfarb

[11] Patent Number: 4,988,321

[45] Date of Patent: Jan. 29, 1991

[54] SURPRISE AND LEARN MOLDING TOY

[76] Inventor: Adolph E. Goldfarb, 1432 S. Eastwind Cir., Westlake Village, Calif. 91361

[21] Appl. No.: 474,526

[22] Filed: Feb. 2, 1990

[51] Int. Cl.[5] ..... A63H 33/00

[52] U.S. Cl. ..... 446/075; 446/491; 434/159

[58] Field of Search ..... 446/71, 75, 76, 491, 446/476, 385; 434/159, 82

[56] References Cited

U.S. PATENT DOCUMENTS 3,097,446 7/1963 Packer ..... 446/385

3,783,554 1/1974 Shapero ..... 446/385 X

*Primary Examiner*—Mickey Yu

*Attorney, Agent, or Firm*—Ashen Martin Seldon Lippman and Scillieri

[57] ABSTRACT

A toy molding device that has one or more mold cavities. Each cavity has a shape that defines a three-dimensional visually recognizable element such as a tree or a cat. Each cavity also has an entrance with a shape that defines a two-dimensional visually recognizable element such as a letter. The two and three-dimensional elements for each cavity are readily recognizable and appreciated by the child-user as being related to one another. For example, a cavity forming a tree may have an entrance in the shape of the letter "T". The child-user may first push moldable material through an entrance into the associated cavity which is at least partially blocked from view; the cavity is then opened to allow removal of the molded three-dimensional element.

21 Claims, 2 Drawing Sheets

FIG. 2
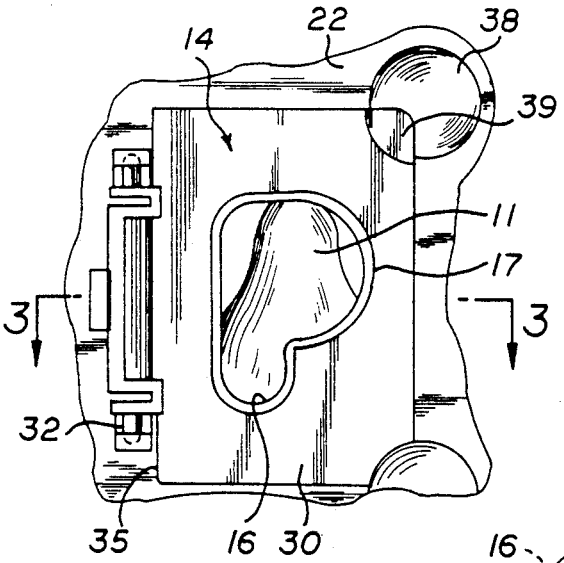
FIG. 3
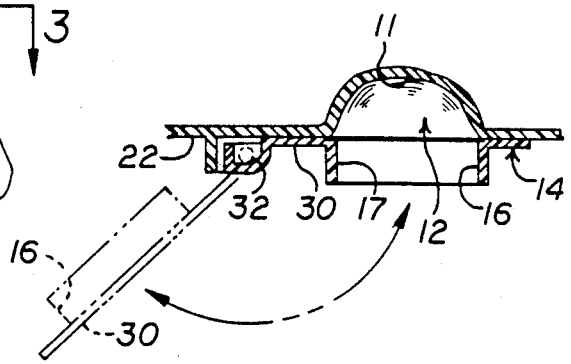
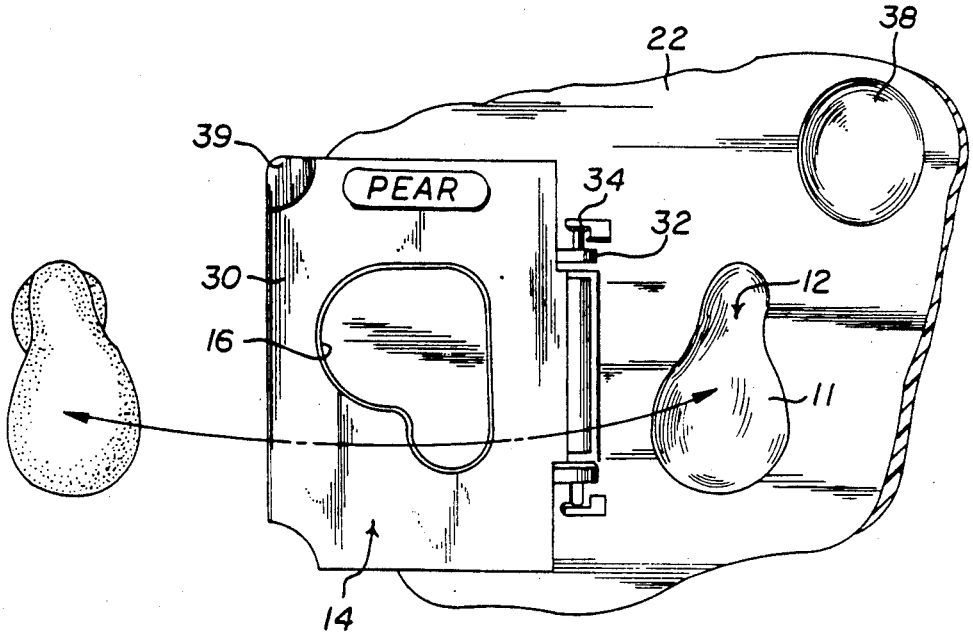
FIG. 4

SURPRISE AND LEARN MOLDING TOY

BACKGROUND OF INVENTION

Young children, particularly pre-schoolers love surprises! They also love to mush and smush about with squeezeable, formable material such as "Playdoh" (a registered trademark of Playdoh, Inc.), clay or the like. Many parents want their child's play activity to include educational elements. Therefore, there have been many toy devices using letters and forms to help teach children the alphabet, words, and the like.

The present toy device contemplates the use of moldable material by young children in a way that offers a surprise element and also an educational aspect.

The prior art has offered a wide variety of molds for allowing children to form moldable material into a variety of three-dimensional shapes and objects. These devices are relatively simple and straight forward but tend to provide more limited attention holding capabilities. Similarly, strongly educational devices where the child identifies letters or numbers or shapes may fail to hold the small child's attention after a short period of time. They also generally require the involvement of parents or other adults or older children to facilitate the learning activity. Examples of these are books that feature the letters of the alphabet or words or pictures or stories associated with such letters. Another example is a device that has pieces shaped like numbers or letters and matching receptacles for receiving such pieces.

None of these prior art devices combine an educational element with an element of surprise, in connection with the use of squeezeable, moldable material.

SUMMARY OF DISCLOSURE

The present invention contemplates a molding toy for a young child. It allows the child to mold an object by introducing a body of moldable material through an entrance opening into a partially obscured mold cavity. There is an element of suspense and surprise when the molded object is removed from the cavity and identified and recognized by the child as having a relationship to the visual appearance of the entrance to the cavity. More particularly, the illustrated molding toy is in the form of a frame that defines a plurality of cavities. Each of the illustrated cavities has a wall with an opening therethrough which provides an entrance into the cavity for introduction of moldable material into the cavity by the child. In one illustrated form, the wall is provided by a hinged door that may be subsequently opened to allow removal of the molded object from the cavity. The two-dimensional shape of the entrance opening and the three-dimensional shape of the cavity (and thus of the resultant molded object) have a readily recognizable relationship to the child. For example, the entrance may define a letter such as "C" and the cavity may define the shape of an object whose name begins with the letter "C" such as "cat". Thus when child initially takes a body of moldable material and pushes it through the entrance into the cavity, the child is not aware of the shape of the cavity or the shape of the object which will be formed in the cavity. The wall around the entrance tends to shield at least part of the cavity from the view of the small child. The child can see that the entrance is in a particular shape such as a letter or number or object such as the outline of a fish or a boat. Thus, the illustrated toy device provides the child with a first two-dimensionally shaped element to consider. The cavity may then be opened (as by swinging open the door in that form of the device) and the molded material removed from the cavity. The child then sees a three-dimensional element which he or she can recognize. To the surprise and amusement of child, the three-dimensional object or element is related to the two-dimensional element defined by the entrance. For example, as noted above, the entrance shape may be a letter and the object may be an item whose name starts with that letter. Alternatively, the entrance might be in the shape of a two dimensional fish and the molded object could be in the shape of a three dimensional fish. In still another example, the entrance might be the outline of a egg and the three-dimensional article might be a chicken.

Thus, not only does the child learn from using this toy device, but there is an element of anticipation and surprise between pushing the moldable material through the entrance into the cavity and subsequently opening the cavity and removing the molded article. All of this, combined with the fun activity of mushing and smushing the moldable material through the entrance into the cavity, provides a highly enjoyable activity for young children.

In the drawings:

FIG. 2 is an enlargement frontal view of one of the molds of FIG. 1, showing the mold closed.

FIG. 3 is a sectional view taken generally along line 3—3 of FIG. 2.

FIG. 4 is an enlarged frontal view of one of the molds of FIG. 1, showing the mold open.

DETAILED DESCRIPTION OF THE DRAWINGS

Figure 1:
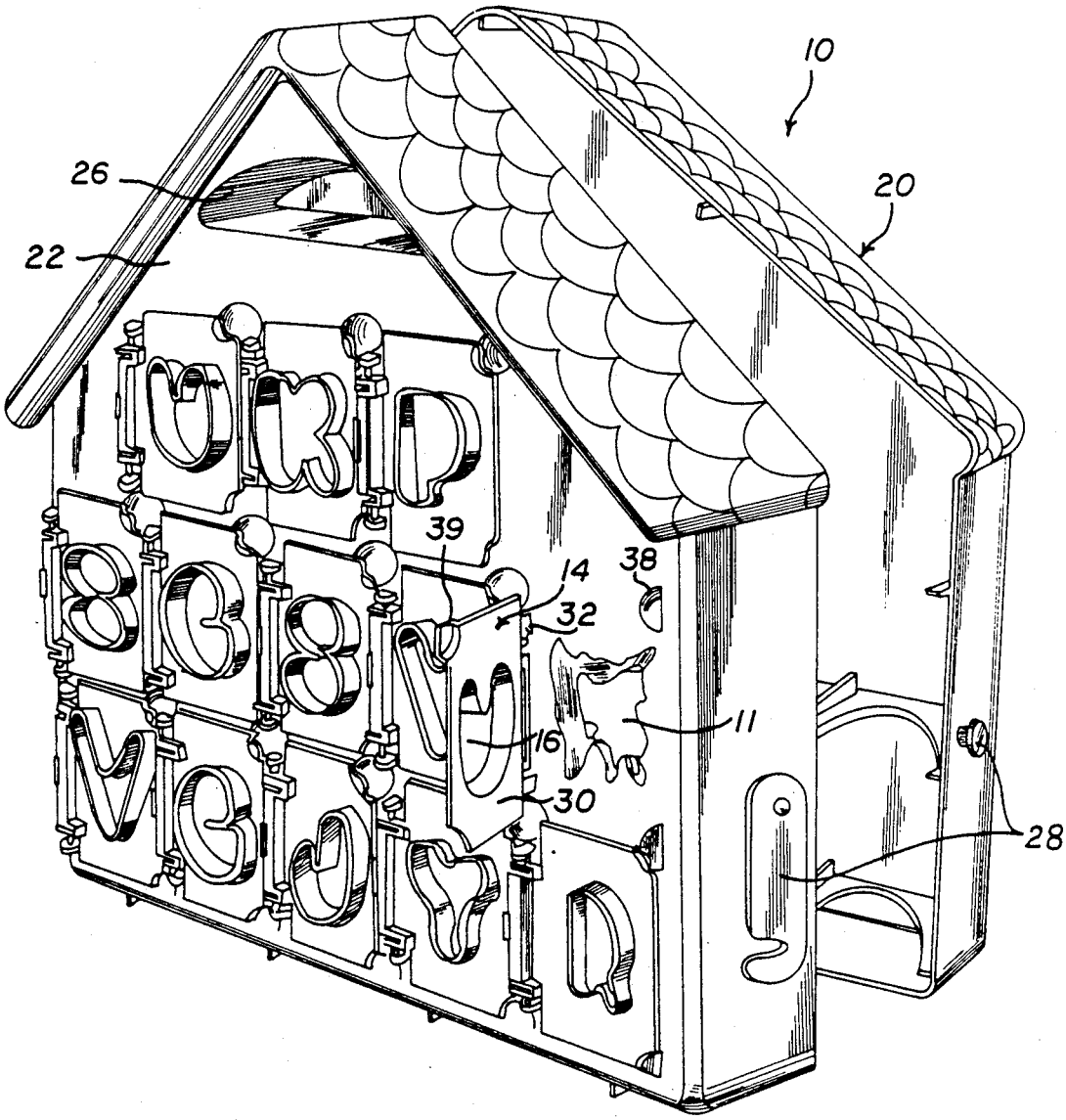
FIG. 1 is a perspective view of a toy in the form of a carrying case having a plurality of the molds which are presently preferred embodiments of the invention.

FIG. 1 illustrates a presently preferred embodiment of the invention in the form of a molding toy (10) having a plurality of mold cavities (12). In this illustrated molding toy (10), opposite faces (22) of a generally rectangular casing or housing (20) are each formed with thirteen recesses that each define a portion of a mold cavity (12). The illustrated mold cavities (12) are arranged in horizontal rows of 3,5 and 5 mold cavities each. Each of the cavities (12), is provided with a wall (14). The illustrated walls (14) are in the form of doors (30) that are provided with hinge means (32) that pivotally interconnect with hinge means (34) on the associated housing face (22). This connects the door (30) along one edge (35) to overly the associated recess (11). The door (30) can pivot or swing to the open position, as shown in FIG. 4 and in broken line in FIG. 3, to provide access to the cavity. When the door (30) is closed, as shown in FIG. 2 and in solid line in FIG. 3, it provides a closure wall (14) for the cavity. Each wall (14) is formed with an entrance opening (16) that is shaped to define a readily identifiable element such as a number or letter or the outline of an object. As noted above, by way of example, the outlined object might be an animal or a person or an inanimate object such as an airplane, a car, the outline of a state or country or whatever. The illustrated entrances (16) are each provided with a peripheral lip (17) that extends outwardly generally perpendicular to the face of the door. This construction facilitates the child pushing moldable material into the cavity. The hinge means (32, 34) may be provided with suitable retaining means (36) (not shown) to releasably maintain the door in the closed position. The adjacent face (22) of the casing (20) may be provided with a suitable depression (38) adjacent a corner (39) of the door (30) to facilitate the young child grasping that corner of the door and moving it to the open position. The corner (39) may be offset as shown best in FIG. 1 to further facilitate easy grasping.

FIGS. 2–4 by way of example, show the configuration of the illustrated cavity (12) as being the shape of a Pear. FIG. 3 shows the associated entrance (16) having the shape of the letter "P", the first letter of the word "Pear".

To add more variety and play value to the molding toy (10), the doors (30) might be detachable from the casing face (22) at the hinge means (32, 34). A plurality of additional doors (30) (not shown) with different entrance openings (16) could be provided for releasable attachment over various of the cavity recesses (11). For example, a cavity recess defining a three-dimensional cat might have a door (30') with an entrance (16) in the shape of a "C", as well as a door (30) with an entrance (16) having the outline of another animal such as a dog; it may have yet another door (30), with an entrance opening (16) in the shape of the outline of a mouse. In such a changeable-door form of the toy device, the multiple doors (30), (30') for a particular cavity recess (11) could be marked to associate with that recess as by color coding or numbering. FIG. 4 shows the door with the "P" shaped entrance 16 marked with the name, "Pear", of the associated recess (11).

The illustrated molding toy (10) may be used as follows: the child takes a body or portion of formable, moldable material "M" such as "Playdoh" (a trademark) or clay and pushes it into an entrance (16) of a mold cavity (12). The material occupies and forms to the shape of the recess (11). Excess material may extend into the area defined by the entrance peripheral lip (17). The child sees and recognizes the two-dimensional shape of the entrance (e.g., the letter "P" of FIGS. 2–4). The child does not readily see the shape of the associated recess (11), which is partially blocked by the closed door (30). Then the child opens the door (30) and removes the molded material "M" from the recess. The three-dimensional shape molded (e.g. the "Pear" of FIGS. 2–4) only then is disclosed to the child. The association can then be made by and/or reenforced to the child between the entrance shape ("P") and the molded object shape ("Pear"). This is not only "fun", but a learning experience for the child.

The illustrated casing (20) is made of mold plastic as are the doors (30). Alternately, the toy device could be formed in whole or part of other material such as metal or wood if desired.

It is highly desirable that the interior surface of the cavity recesses (11) be made of a relatively smooth non-porous, non-sticking material such as polystyrene, polyurathane, polypropolane; this ensures that the moldable material "M" can be readily removed from the recess by the child. A coating or layer on the mold cavity recess inner surface may also be used to facilitate this ready removability. The particular requirements for the non-sticking characteristic of the inner surface of the recess is related to and dependent upon the particular moldable material and its ability to readily release or detach from such a surface.

The illustrated case (20) is openable to provide the ability to carry moldable material "M" (or any other objects the child may want to carry). The illustrated case (20) is also provided with a carrying handle (26) and latch means (28) for releasably maintaining the case in the closed position.

The specific construction of the cavity may take various alternate forms, all within the spirit and scope of the present invention as set forth in the following claims. For example, the wall providing the entrance opening could be fixed and the wall defining the recess could be moveable relative to it to provide access to the recess cavity. Similarly, the door need not be hinged but might be slideable or swivel around a pivot point. The door way also might be a separate part that is simply releasably snapped in place (although for small children it is desireable not to have separate pieces).

What is claimed is:

1. A toy molding device comprising means defining a cavity, said cavity-defining means having a wall portion defining an entrance having a shape that represents a two-dimensional element visually identifiable by the child-user, said entrance being proportioned to allow a body of moldable material to be inserted through said entrance to substantially occupy said cavity, said cavity having a shape that represents a three-dimensional element visually identifiable by the child-user, said two and three-dimensional elements having a relationship to one another readily appreciated by the child-user, said wall portion at least partially blocking the cavity from the view of the child-user, said cavity-defining means being openable to provide full access to the cavity so as to allow an object formed in the cavity in the shape of the three-dimensional element by the moldable material to be removed from the cavity.

2. A toy molding device as set forth in claim 1 comprising a plurality of said cavity-defining means.

3. A toy molding device as set forth in claim 2 wherein said plurality of cavity-defining means are mounted on a common frame.

4. A toy molding device is set forth in claim 1 wherein said wall portion is in the form of an openable door to provide access to the cavity and said entrance extends through said door.

5. A toy molding device as set forth in claim 4 wherein said door is pivotally mounted on said device adjacent said associated cavity.

6. A toy molding device as set forth in claim 4 wherein said door is slidingly mounted over said cavity.

7. A toy molding device as set forth in claim 4 wherein said door is mounted for swiveling movement about an axis generally perpendicular to the plane of the door.

8. A toy molding device as set forth in claim 4 wherein said door is a separate piece detachably mountable over said cavity.

9. A toy molding device as set forth in claim 4 wherein said device includes a wall in which the cavity is formed and said wall has a depression adjacent an outer portion of the door to provide ready access under that portion of that door for opening the door.

10. A toy molding device as set forth in claim 4 wherein releasable holding means are provided for releasably maintaining the door in the closed position.

11. A toy molding device as set forth in claim 10 wherein said releasable holding means are in the form of resilient spring means.

12. A toy molding device as set forth in claim 10 wherein said holding means are in the form of detent means.

13. A toy molding device as set forth in claim 1 wherein said device comprises a relatively thin cavity wall of moldable plastic material which is shaped to define the cavity.

14. A toy molding device as set forth in claim 1 wherein said cavity means includes a cavity surface that is generally smooth non-porous for readily separating from a body of moldable material occupying the cavity.

15. A toy molding device as set forth in claim 3 wherein said frame defines a carrying case which is openable and has a releasable closure and a carrying handle.

16. A toy molding device as set forth in claim 1 wherein said entrance is in the shape of a letter.

17. A toy molding device as set forth in claim 1 wherein said entrance is in the shape of a number.

18. A toy molding device as set forth in claim 1 wherein said entrance is in the shape of the two-dimensional outline of a three-dimensional object.

19. A toy molding device as set forth in claim 16 wherein said cavity has a shape of an object whose name begins with the letter of the associated entrance.

20. A toy molding device as set forth in claim 8 wherein there are a plurality of cavities and doors, and at least one of said doors has a relationship to more than one of said cavities.

21. A toy molding device comprising a cavity wall formed by a sheet of formed plastic material to provide a plurality of cavities, each of said cavities having a shape that represents a three-dimensional element visually identifiable by the child-user, each of said cavities having an associated door mounted on the cavity wall so as to extend over the associated cavity and so as to be moveable from that closed position to an open position affording access into the cavity, each of said doors defining an entrance having a shape that represents a two-dimensional element visually identifiable by the child-user, said two and three-dimensional element having a relationship to one another readily appreciated by the child-user, each of the doors at least partially blocking the view of the child-user into the interior of the associated cavity, whereby the child-user may introduce moldable material through each entrance into the associated cavity without fully seeing or appreciating the identity of the three-dimensional element defined by that cavity, and may subsequently open the associated door and remove the molded three-dimensional object formed in that cavity and observe the relationship between the shape of the two-dimensional element defined by the entrance and the three-dimensional element of the molded object.

* * * * *